United States Patent [19]

Albert

[11] 4,139,170

[45] Feb. 13, 1979

[54] COMMAND CONTROL SYSTEM

[75] Inventor: Joseph J. Albert, Timonium, Md.

[73] Assignee: Martin Marietta Corporation, Orlando, Fla.

[21] Appl. No.: 635,533

[22] Filed: Jan. 22, 1957

[51] Int. Cl. ..... F41g 7/18; F41g 9/00; H04b 1/10

[52] U.S. Cl. ..... 244/3.1; 325/42; 325/476; 325/323; 364/439; 364/440; 364/494; 364/819

[58] Field of Search ..... 244/3.1; 325/42, 476, 325/323, 324; 364/819, 439, 440, 441; 343/100 CL

[56] References Cited

U.S. PATENT DOCUMENTS

| | | | |
|---|---|---|---|
| 2,801,351 | 7/1957 | Calvert | 307/149 |
| 3,428,794 | 2/1969 | Norsworthy | 364/819 |
| 3,450,869 | 6/1969 | Wiley et al. | 364/819 |

*Primary Examiner*—Samuel W. Engle
*Assistant Examiner*—Thomas H. Webb
*Attorney, Agent, or Firm*—Julian C. Renfro; Gay Chin

EXEMPLARY CLAIM

10. A method for use in controlling the travel of a vehicle comprising the steps of first deriving two narrow band noise signals of different frequencies, then delaying one of said signals by an amount which constitutes the information which will control the path of the vehicle, next adding the delayed and undelayed signals to form a composite signal, subsequently transmitting the composite signal to a receiver in the vehicle, then applying the composite signal to a non-linear device in said receiver along with a duplicate waveform of itself which has been delayed in time, subsequently deriving from the non-linear operation through the step of filtering a signal at the difference frequency between the two original noise signals, which signal is a function of the correlation between said composite signal and its delayed duplicate waveform, and lastly applying said difference frequency signal to a non-linear device to generate control signals which are proportional to said correlation.

11. A method for use in controlling the travel of a vehicle comprising the steps of first deriving from a common narrow band noise source, two noise signals of difference frequencies, then delaying one of said signals by an amount which constitutes the information which will control the path of the vehicle, next adding the delayed and undelayed signals to form a composite signal, subsequently transmitting the composite signal to a receiver in the vehicle, then applying the composite signal to a non-linear device in said receiver along with a duplicate waveform of itself which has been delayed in time, subsequently deriving from the non-linear operation a signal at the difference frequency between the two original noise signals, which signal is a function of the correlation between said composite signal and its delayed duplicate waveform, said correlation indicating the information controlling the path of the vehicle, and lastly applying said signal to a detector and relay in order to control the power that is used to move the controls of the vehicle.

17 Claims, 3 Drawing Figures

INVENTOR

Joseph J. Albert

BY Julian C. Renfro

ATTORNEY

INVENTOR

Joseph J. Albert

BY

Julian C. Renfro

ATTORNEY

COMMAND CONTROL SYSTEM

This invention relates to a command control system for controlling the travel of a vehicle, and more particularly to a system adapted for the transmission of signals or commands to a missile in flight, to control its course and target approach.

In the past, many types and forms of control systems for transmitting information, such as command signals to a missile have been proposed, but many of these systems have had limited military application because of their susceptibility to detection and jamming. According to the present invention, however, an improved type of command system is provided, which employs novel correlation techniques whereby jamming and detection of command signals other than by the receiving equipment of the missile is rendered as difficult as possible. Noise signals are advantageously employed in conjunction with these correlation techniques, for as is known, noise signal systems have unique military value due to their ability to be jam-proof and secure (undetectable).

The concept of utilizing a noise signal and a continuous correlation detector in an electronic system was described at some length in the copending application of Joseph J. Albert filed May 22, 1956, Ser. No. 586,538.

Consider the correlation function of a function of time, f(t)

$$\phi(\tau) = \lim_{T\to\infty} \frac{1}{2T} \int_{-T}^{T} f(t)f(t-\tau)dt$$

where $\tau$ is delay. For different values of delay, the function exhibits a different amount of correlation or matching. The correlation function of a periodic signal will be periodic in delay, exhibiting a maximum whenever the delay is such as to produce the best "matching" of the delayed and undelayed functions. However, random functions exhibit less and less "matching" or correlation as delay is changed from zero. It is this property of random functions which permits the synthesis of many systems of military value, since the ordinates of such a correlation function can indicate, without ambiguity, the amount of delay between the functions. The location of objects in space can thus be determined using ideal random signals and correlation detection, and different values of delay can be used to represent different symbols in a communication system employing these techniques. Since large improvements in signal to noise ratio are possible via correlation detection, systems employing such detection and noise signals are potentially more secure and potentially less susceptible to jamming than conventional electronic systems.

Typical correlation function for narrow band noise is illustrated graphically in the first figure of the drawing, and the period of a function of this type is essentially determined by the center frequency of the pass band. The envelope of the function, however, is determined by bandwidth, a wider bandwidth making the envelope fall off more rapidly. Although a noise signal delayed in time by several periods of the bandwidth is essentially unrelated to the undelayed noise signal, nevertheless, if the delayed and undelayed signals are added, a correlation necessarily follows based upon the period of delay. Computation of the correlation function, according to accepted mathematical equations, of the composite signal at the preselected value of delay will indicate the presence of the delayed noise. It is possible to evolve a continuous noise system by switching in a different value of delay for each symbol to be transmitted and computing the correlation at each value of delay in the receiver.

Since a period of the correlation function is the same magnitude in delay as a period of the band center frequency in time, the computation of a specific ordinate of the correlation function requires excellent stability of delay in order to avoid drifting to points of zero output. This requirement is difficult to satisfy, and it has been discovered that other arrangements are more practical. For example, much less stability is required if one noise signal is shifted in frequency with respect to the other by a small amount. Then, instead of developing a DC output from the correlator in the receiver, the difference frequency is generated and can be averaged with a narrow band filter. Since this difference frequency can be generated at any value of delay and its magnitude will be that of the envelope of the correlation function, this arrangement is greatly preferred over other less satisfactory schemes. The stability of delay under the circmustances described is dictated by input bandwidth for its static value and the tolerable rate of change of delay is determined by the bandwidth of the integrating filter.

According to the present system, a transmitter is provided having means to derive two signals of different frequencies, means to combine a noise signal with each of said two signals in order to translate the noise to bands of frequency which differ from each other by small amount, means to delay one of said translated noise signals, and means to add the delayed noise signal and the undelayed noise signal. Receiving means are provided having means to operate upon the composite signal by multiplying it with a duplicate waveform of itself which has been delayed in time to derive a signal which is a function of the correlation between the first mentioned composite signal and its duplicate but delayed waveform. A system according to this invention is particularly adapted for military communication purposes utilizing highly encoded signals.

This system may be employed as a method for controlling the travel of a vehicle, which method comprises the steps of deriving from a common noise source two noise signals of different frequency, delaying one of said signals by an amount which constitutes the information which will control the path of the vehicle, adding the delayed and undelayed signals, and transmitting the composite signal to a receiver in the vehicle. The perturbed composite signal is applied to a non-linear device in the receiver along with a duplicate waveform of itself which has been delayed in time, and from the non-linear operation, a signal at the difference frequency between the original noise signals is derived, which is a function of the correlation between the composite signal and its delayed duplicate waveform, said correlation indicating the information controlling the path of the vehicle. The difference frequency signal is then applied to a non-linear device to generate control signals which are proportional to the correlation.

Accordingly, it is an object of the present invention to provide a command link for transmitting information to a vehicle such as a missile in flight, to control or otherwise govern the path of travel of the vehicle.

It is another object of this invention to provide a command control system uniquely designed to be operative against jamming, and to be difficult of detecting.

It is another object of this invention to provide a system capable of operating with perturbed signals, but which are capable of applying unperturbed signals to the controls of a vehicle whose path of travel is to be controlled.

Other and further objects of the present invention will become more fully apparent from the following detailed description of the preferred embodiment of the present invention, when considered in conjunction with the appended drawings in which.

Figure 1:
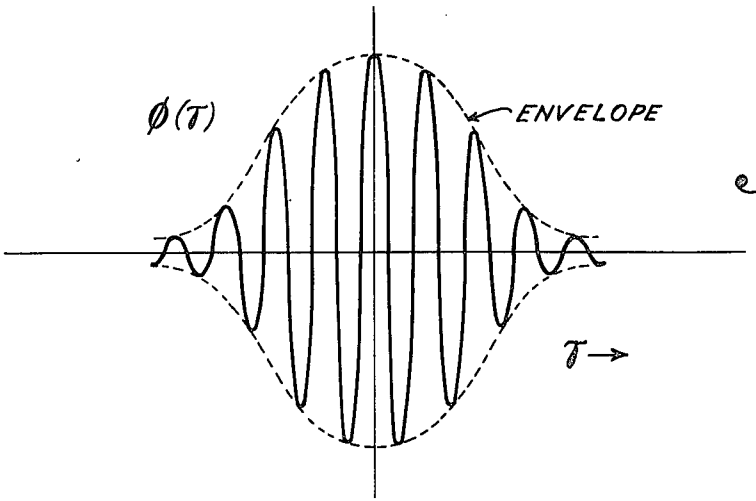
FIG. 1 is a graphic representation of the correlation function of narrow band noise.

Referring to the drawings, a preferred embodiment of the present invention is now described in detail.

The system of the present invention is particularly adapted for radiating narrow band noise signals from a command transmitter to a guided missile in flight. The noise signals are three in number and include a reference signal, a left-right signal, and an up-down signal. The transmitter can be located at any one of a number of stations, such as in a launch or guiding plane or at a ground station. The various noise signals are represented by different values of delay in order to enable their being handled with discrimination. In addition to being delayed, the noise signals representative of various symbols are shifted slightly in frequency with respect to the reference signal. As part of each of the up-down and left-right signals, a neutral signal is radiated by the transmitter to avoid changing the RMS value of radiated noise. In the receiver, however, the neutral signal is not required and correlation detection is performed only at the values of delay corresponding to left-right and up-down.

The output signal to noise ratio is proportional to the ratio of input bandwidth to bandwidth of the averaging filters. Since the signals are applied at a predetermined rate to the control system of the missile being guided, there is a lower limitation on the output bandwidth. It is, therefore, advantageous to select as wide an input bandwidth to the correlating units as possible. A reasonable value for bandwidth in the system of the present invention has been found to be 5 megacycles. If a 10 cycle output bandwidth is used, output signal to noise ratio will be +20db when input signal to noise ratio to the multipliers of the correlating units is, as a consequence of thermal noise or jamming, as low as −20db. Since bandwidths of 10 to 100 cycles can be easily achieved at 10,000 cycles, frequencies in this neighborhood are useful for the difference frequency of the noise bands.

Figure 2:
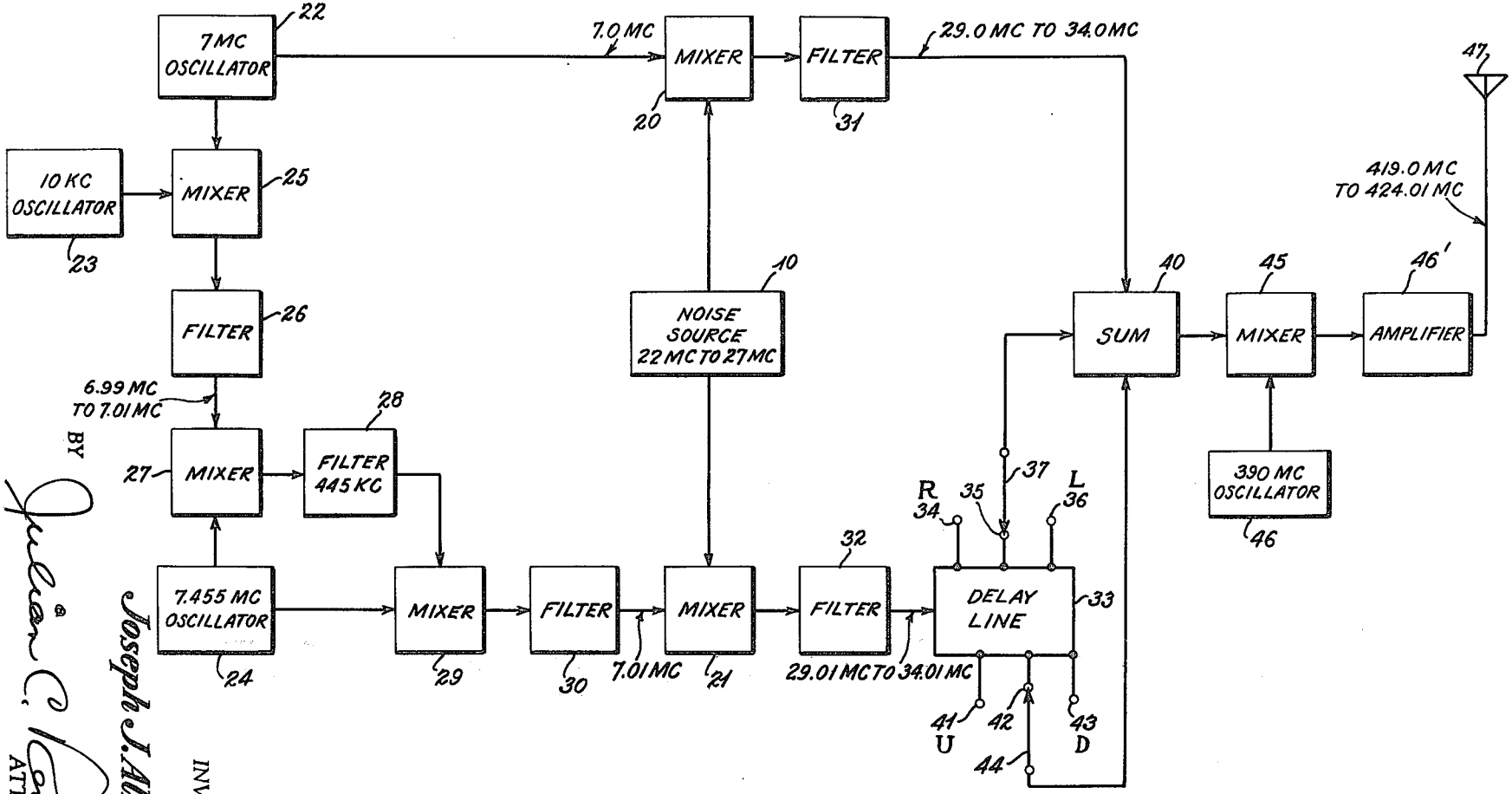
FIG. 2 is a block diagram of the command transmitter.

Referring now to FIG. 2, the preferred command transmitter is illustrated in block diagram. The transmitter apparatus is essentially comprised of a suitable noise source 10 operating in the frequency range from 22 mc. to 27 mc. The noise source may be selected from any convenient or known source. It has been found that a noise source composed of an IF strip, the output of which is amplified thermal and shot noise, is satisfactory. The output from the noise source 10 is fed to mixers 20 and 21.

It is essential in this apparatus to derive a difference frequency, and it has been found that the invention can be practiced using frequencies that differ by only 0.01 mc. There are many methods which could be employed for deriving two frequencies that would provide the requisite difference frequency, and for the purpose of illustration one such method is illustrated in FIG. 2. It should be borne in mind, however, that the important consideration in the derivation of the difference frequency is the stability of the difference frequency so that it will not drift out of the pass band of the averaging filters. There are provided a 7 mc. oscillator 22, a 10 kc. oscillator 23 and a 7.455 mc. oscillator 24. The characteristic output frequencies from the oscillators 22 and 23 are beat together in a mixer 25 with the output passing through filter 26. By design, the output from the filter 26 is a signal in the frequency range of from 6.99 mc. to 7.01 mc. This signal goes to a mixer 27 into which is also fed the characteristic output frequency of the oscillator 24. The output from mixer 27 passes through a filter 28 designed to pass only 445 kc. The output of oscillator 24 is also fed to a mixer 29 which, in addition, receives the output from the 445 kc filter 28. The output from mixer 29 is then passed through a filter 30 designed to pass only 7.01 mc., and then is fed to mixer 21. Thus, the input to mixer 21 includes the narrow band noise ranging in frequency from 22 to 27 mc. from noise source 10, as well as the 7.01 mc. output from filter 30.

The output from the 7 mc. oscillator 22 is fed to mixer 20 where it is combined with the narrow band noise originating in noise source 10. The output from the mixer 20 passes through a filter 31 which is designed to pass only signals in the frequency range of 29.0 to 34.0 mc. The output of the filter 31 is sent to a summing circuit 40.

Returning to mixer 21, the output from this device passes through a filter 32, which passes signals in the frequency range of 29.01 to 34.01 mc., into a delay line 33. Delay line 33 is tapped at several points to derive different delayed signals indicative of information or commands to be transmitted. Hence, there is provided a tap 34 for a preselected delay indicative of a right command, a tap 35 for a preselected delay indicative of a neutral command, and a tap 36 for a preselected delay indicative of a left command. The letters R and L appear beside taps 34 and 36 in FIG. 2 to indicate the right and left directions, respectively. A switch 37 is provided adapted to contact selectively any one of the taps 34, 35, and 36, and the delayed signal appearing at switch 37 is fed to a summing circuit 40.

The delay line 33 is also provided with taps 41, 42 and 43 for deriving from it delayed signals indicative of up, neutral and down commands, respectively, with the letters U and D beside taps 41 and 43 being employed to indicate the up and down directions, respectively. Switch 44 is provided to contact one of the tape 41 to 43 and to direct delayed signals to the summing circuit 40. It will be apparent that there are three inputs to the summing circuit 40, namely, a reference signal from the band pass filter 31 operating with a pass band of 29.0 mc. to 34.0 mc., an up-down signal, and a left-right signal. The last two signals are each shifted in frequency by 0.01 mc. with respect to the reference signal and hence lie in the frequency range of from 29.01 mc. to 34.01 mc. When the signals are added or summed in the circuit 40, it will be evident that they will be combined with the left-right signal and up-down signal delayed by different times with respect to the reference signal. In addition, the signals are combined to include the difference frequency purposely introduced. Thus, the composite signal occupies a frequency band of 29.0 mc. to 34.01 mc.

The output from the summing circuit 40 is passed to a mixer 45 and combined with a 390 mc. signal originating from a suitable 390 mc. oscillator 46'. The output signal from the mixer 45 then ranges in frequency from 419.0 mc. to 424.01 mc. This signal is then amplified by amplifier 46 and transmitted via antenna 47.

Figure 3:
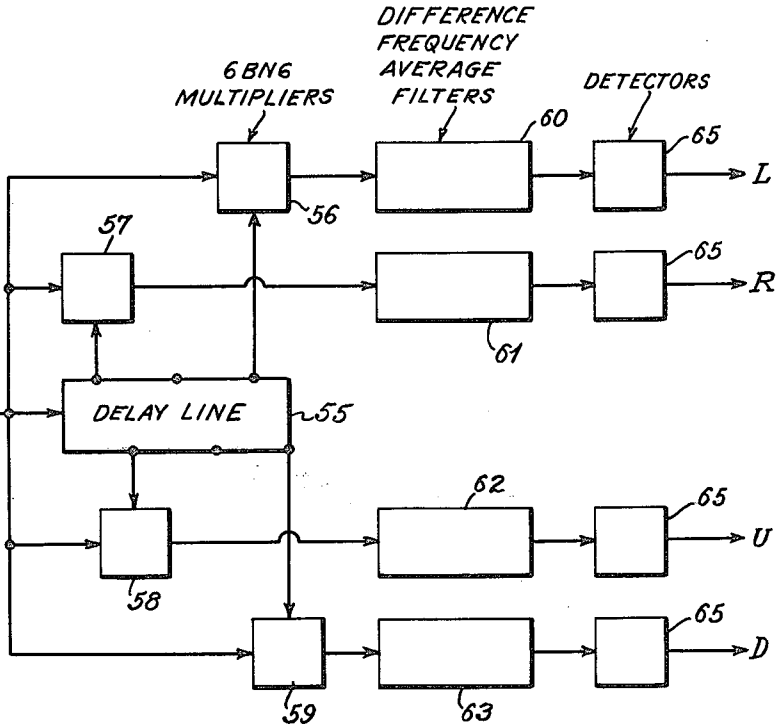
FIG. 3 is a block diagram of a receiving unit adapted to be located in a missile.
Figure 3:
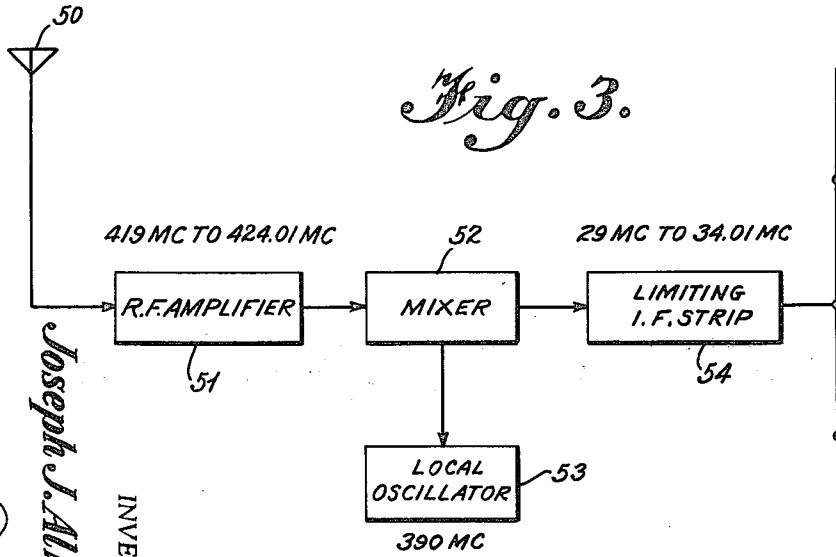

The receiving equipment located in the missile is illustrated in the block diagram of FIG. 3. This equipment comprises a receiving antenna 50 to which is connected an RF amplifier 51. The signals picked up by the antenna 50 are perturbed signals which include the noise signals which were radiated by the antenna 47 of the transmitting equipment, ambient and thermal noise and any jamming signals. The RF amplifier 51 filters out all but signals in the range of 419.0 mc. to 424.01 mc. A mixer 52 is connected to receive the output of RF amplifier 51 as well as a 390 mc. signal developed by a local oscillator 53. The narrow band noise signal is then passed to a limiting IF strip 54 wherein the signal now ranging in frequency from 29 mc. to 34.01 mc. is amplified.

The output from IF strip 54 is divided into a plurality of paths with one path leading directly to a delay line 55, similar to the delay line 33, with taps arranged in corresponding positions at corresponding delays. Each output from the IF strip 54 leads to one of the four non-linear devices (multipliers) 56, 57, 58 and 59. Each tap on the delay line 55, with the exception of those taps corresponding in position to the neutral taps of delay line 33, is connected to one of the multipliers 56 to 59. The output from each multiplier is passed to a difference frequency averaging filter arranged to pass 10 kc. The difference frequency averaging filters have been designated in FIG. 3 by the numbers 60, 61, 62 and 63, corresponding respectively, with the multipliers 56 to 59. The output from each difference frequency averaging filter is fed to a respective non-linear device, such as a detector 65 which determines the presence or absence of a command signal. The various commands associated with each detector 65 have been indicated at the end of an arrow head leading from the respective detector 65. The difference frequency averaging filters 60 to 63 may be selected from any of the well known apparatus useful for this purpose. There may be mentioned crystals and magneto striction rods.

The delay 33 of the transmitter in effect functions to repeat the reference signal at a preselected delay time, and the delay signal is then combined with the reference signal in summing circuit 40. When received, the signal can be handled to reveal the command it contains merely by subjecting it to correlation detection techniques. The key is that, the delay times initially introduced by delay line 33 are repeated by delay line 55. This results in the delayed reference signal and the undelayed command signal coinciding in point of time, at multipliers in the receiver. Since they are the same signal in reality, (except for a frequency shift) and since they are commencing at the same instant, maximum correlation will be exhibited. For different delay times, correlation will be less approaching zero for large discrepancies in delay times. This then, is the means by which the commands are sorted out or separated. Thus, by using different delay times in delay line 33 and repeating them in delay line 55 or having related delay times in delay line 55 commands can be easily transmitted and detected by correlation techniques. Only one of the detectors 65 will be activated for each command transmitted. Although the delay times in lines 33 and 55 need not be exactly the same, they must bear a definite relationship.

With the system of the present invention it has been empirically determined that the transmitted power must be in the neighborhood of milliwatts to render the system secure (radiated noise weaker than thermal noise over most of the useful range of the system). It is recommended that at least 5 watts of power be available, however, as a reserve in the event of attempted jamming of the equipment. Assuming similar distances and antenna patterns, the output signal to noise ratio of a 5 watts system would be about 20 dbs., if the system were being jammed with 500 watts of noise in the right frequency band.

The frequency band to be employed with the apparatus will be 406 to 430 mc. All components of the equipment are fixed tuned and hence, will function reliably and yet be simple and inexpensive.

It is also recommended that the reference signal amplitude be somewhat higher than the other noises so that repetition of wave form will be more thoroughly masked and consequently will be more difficult to detect.

To avoid any possibility of commands from one ground station or aircraft from directing the missiles of another aircraft or ground station, a different difference frequency can be used for each control station.

Although the present invention has been shown and described with reference to a preferred embodiment, it is appreciated that various changes and modifications, such as are obvious to one skilled in this art, are deemed to be in the spirit, scope and contemplation of the present invention.

I Claim:

1. A system comprising means to generate a reference narrow band noise signal added to a delayed duplicate waveform of itself so as to form a composite signal, and, including a multiplier, for handling the composite signal after perturbation by multiplying it with a duplicate waveform of itself which has been delayed a preselected interval, said multiplier supplying a signal which is a function of the correlation between said composite signal and its duplicate waveform.

2. A system comprising means to derive two narrow band noise signals of different frequencies, means to delay one of said two noise signals, means to add said two signals to form a composite signal, and means to handle said composite signal after perturbation, said means including a non-linear device to which said signal is applied along with a duplicate waveform of itself which has been delayed in time, said non-linear device supplying a signal which is a function of the correlation between said composite signal and its delayed duplicate waveform.

3. A system comprising means to derive two signals of different frequencies, means to combine a narrow band noise signal with each of said two signals in order to translate the noise to bands of frequency which differ from each other by a small amount, means to delay one of said translated noise signals, means to add said delayed noise signal and the undelayed noise signal to form a composite signal, and means to operate upon said composite signal including means for multiplying it with a duplicate waveform of itself which has been delayed in time to derive a signal which is a function of the correlation between said composite signal and its duplicate waveform.

4. A command control system comprising means to derive two signals of different frequencies, means to combine a narrow band noise signal with each of said two signals in order to translate the noise to bands of frequency which differ from each other by a small amount, means to delay one of said translated noise signals, means to add said delayed noise signal and the undelayed noise signal to form a composite signal, and means to operate upon said composite signal by multiplying it with a duplicate waveform of itself, latter means including filter means, whereby said signal has been delayed in time to derive a signal which, when filtered, is a function of the correlation between said composite signal and its duplicate waveform, thereby indicating the presence of a command.

5. A system as defined in claim 4 wherein the last named means includes a delay line, a multiplier, a detector, and said filter means is a difference frequency filter.

6. A system comprising means to derive two related narrow band noise signals of different frequencies, means to delay one of said two signals, means to combine said two signals into a composite signal, means to transmit said composite signal, means to receive said composite signal, and means to handle said composite signal including means for mixing it with a duplicate waveform of itself which has been delayed in time and deriving from the mixing action a signal which is a function of the correlation between said composite signal and its duplicate waveform.

7. A command control system comprising means to generate and transmit a command narrow band noise signal composed of a reference signal combined with a duplicate waveform of itself which has been shifted in frequency and delayed by a preselected interval, means to receive said transmitted command signal and means to handle said transmitted command signal by combining it with a duplicate waveform of itself which has been delayed a preselected interval and deriving by means of a filter a signal which is a measure of the correlation between the command signal and its duplicate waveform to reveal the presence of a command.

8. A system as defined in claim 7 wherein said last named means includes a delay line, a multiplier, a difference frequency filter and a detector.

9. A command control system comprising means to generate and transmit a composite command signal composed of a reference narrow band noise signal combined with a frequency translated version of itself which has been delayed by a preselected interval, means to receive a perturbed version of said composite signal and means to handle said perturbed composite signal by applying it to a non-linear device along with a duplicate waveform of itself which has been delayed a preselected interval to derive from the non-linear device a signal which is a function of the correlation between the perturbed composite signal and its duplicate waveform thereby to reveal the presence of a command.

10. A method for use in controlling the travel of a vehicle comprising the steps of first deriving two narrow band noise signals of different frequencies, then delaying one of said signals by an amount which constitutes the information which will control the path of the vehicle, next adding the delayed and undelayed signals to form a composite signal, subsequently transmitting the composite signal to a receiver in the vehicle, then applying the composite signal to a non-linear device in said receiver along with a duplicate waveform of itself which has been delayed in time, subsequently deriving from the non-linear operation through the step of filtering a signal at the difference frequency between the two original noise signals, which signal is a function of the correlation between said composite signal and its delayed duplicate waveform, and lastly applying said difference frequency signal to a non-linear device to generate control signals which are proportional to said correlation.

11. A method for use in controlling the travel of a vehicle comprising the steps of first deriving from a common narrow band noise source, two noise signals of difference frequencies, then delaying one of said signals by an amount which constitutes the information which will control the path of the vehicle, next adding the delayed and undelayed signals to form a composite signal, subsequently transmitting the composite signal to a receiver in the vehicle, then applying the composite signal to a non-linear device in said receiver along with a duplicate waveform of itself which has been delayed in time, subsequently deriving from the non-linear operation a signal at the difference frequency between the two original noise signals, which signal is a function of the correlation between said composite signal and its delayed duplicate waveform, said correlation indicating the information controlling the path of the vehicle, and lastly applying said signal to a detector and relay in order to control the power that is used to move the controls of the vehicle.

12. A command control system comprising a transmitter for sending highly encoded signals for military communication purposes, which transmitter includes means to derive two signals of different frequencies, means to combine a narrow band noise signal with each of said two signals in order to translate the noise to two slightly different frequencies, means to delay one of said translated noise signals, means to add the delayed and the undelayed noise signals to form a composite signal, and additional frequency translation circuits to translate the composite signal to an appropriate frequency for transmission in the electromagnetic spectrum, said transmitter in combination with a receiver for receiving a perturbed version of said composite signal, said receiver including means to delay a portion of the composite signal, multipliers for operating upon said composite signal and the delayed version of said composite signal from said delay means in order to generate difference frequency signals at the difference frequency between the components of the composite signal, filter means tuned to render said difference frequency signals unperturbed, said difference frequency signals being a function of correlation between the undelayed and delayed composite signals constituting the information received, and non-linear devices to generate signals which are proportional to said correlation.

13. A transmitter for sending highly encoded signals for military communication purposes which comprises means to derive two signals of different frequencies, means to combine a narrow band noise signal with each of said two signals in order to translate the noise to two slightly different frequencies, means to delay one of said translated noise signals, means to add the delayed and the undelayed noise signals to form a composite signal, and additional frequency translation circuits to translate the composite signal to an appropriate frequency for transmission in the electromagnetic spectrum.

14. A receiver for receiving a perturbed composite signal which comprises means to delay a portion of the composite signal, multipliers for operating upon said composite signal and the delayed version of said composite signal from said delay means in order to generate difference frequency signals at the difference frequency between the components of the composite signal, filter means tuned to render said difference frequency signals unperturbed, said difference frequency signals being a function of correlation between the undelayed and delayed composite signals constituting the information received, and non-linear devices to generate signals which are functionally related to said correlation.

15. A system for the communication of intelligence comprising means to generate a first substantially non-repetitive signal, said signal being uniquely identified as specific spectrum distribution of energy with a specific time history of said signal, means to produce at least one replica of said first signal, the spectrum distribution of said replica being shifted in frequency from that of said first signal by a specific amount and delayed by a specific amount of time, highly encoded intelligence thereby being provided by the selective observation of said specific spectral shift and said time delay.

16. A system as defined in the claim 15 in which a substantially non-repetitive signal is hetrodyned against at least two oscillators having specific frequency separations so as to produce sum and difference products possessing spectral separations representing the desired intelligence.

17. A receiver for highly encoded signals comprising means to receive signals having a continuous spectrum and at least one frequency shifted replica of said signals, means to multiply together said received signals, means to extract the products produced by said multiplier means, and to pass said products thru narrow band tuned filter means, and detection means to detect the presence of output from said narrow band filter means, said detection means being for the purpose of extracting intelligence represented by said frequency shift.

* * * * *